US009869127B2

(12) United States Patent
Williams et al.

(10) Patent No.: US 9,869,127 B2
(45) Date of Patent: Jan. 16, 2018

(54) DOWN HOLE MOTOR APPARATUS AND METHOD

(71) Applicant: SUPREME SOURCE ENERGY SERVICES, INC., Houston, TX (US)

(72) Inventors: Danny T. Williams, Katy, TX (US); Massoud Panahi, Katy, TX (US)

(73) Assignee: SUPREME SOURCE ENERGY SERVICES, INC., Houston, TX (US)

( * ) Notice: Subject to any disclaimer, the term of this patent is extended or adjusted under 35 U.S.C. 154(b) by 889 days.

(21) Appl. No.: 13/910,289

(22) Filed: Jun. 5, 2013

(65) Prior Publication Data

US 2014/0360787 A1 Dec. 11, 2014

(51) Int. Cl.
*E21B 7/06* (2006.01)

(52) U.S. Cl.
CPC ..... *E21B 7/067* (2013.01); *E21B 7/062* (2013.01); *E21B 7/068* (2013.01)

(58) Field of Classification Search
CPC ..... E21B 7/10; E21B 7/067; E21B 4/02
See application file for complete search history.

(56) References Cited

U.S. PATENT DOCUMENTS 4,729,675 A * 3/1988 Trzeciak ..... E21B 4/003 175/107
4,932,482 A * 6/1990 DeLucia ..... E21B 4/02 175/107
5,090,497 A 2/1992 Beimgraben et al.
5,265,687 A 11/1993 Gray
5,269,385 A 12/1993 Sihlis
5,311,952 A 5/1994 Eddison et al.
5,341,886 A 8/1994 Patton
5,439,064 A 8/1995 Patton
5,725,061 A * 3/1998 Van Steenwyk ..... E21B 4/02 175/104
5,738,178 A 4/1998 Williams et al.
6,176,327 B1 1/2001 Hearn
(Continued)

FOREIGN PATENT DOCUMENTS

GB 2458909 A 7/2009

OTHER PUBLICATIONS

Merriam-Webster, Accessed Apr. 2017, https://www.merriam-webster.com/dictionary/integral.*

*Primary Examiner* — Robert E Fuller
*Assistant Examiner* — David Carroll
(74) *Attorney, Agent, or Firm* — Rao DeBoer Osterrieder, PLLC; Dileep P. Rao

(57) ABSTRACT

A motor apparatus attached to a work string in a well. The apparatus includes a power housing having a rotor-stator member for creating a rotational force, with the power section being attached to the work string; an intermediate housing attached to the power housing; and a flexible coupling unit partially disposed within the intermediate housing. The apparatus further includes a bearing housing attached to the intermediate housing, wherein the bearing housing contains a thrust and radial bearings, and wherein the bearing housing is partially disposed about a portion of the flexible coupling unit. The bearing housing has a first and second axis, wherein the first axis is parallel to the power section axis and the second axis is angularly offset to the power section axis.

11 Claims, 4 Drawing Sheets

(56) References Cited

U.S. PATENT DOCUMENTS

| | | | | |
|---|---|---|---|---|
| 6,213,226 | B1 | 4/2001 | Eppink et al. | |
| 6,554,083 | B1 | 4/2003 | Kerstetter | |
| 6,629,571 | B1 | 10/2003 | Downie | |
| 7,096,979 | B2 | 8/2006 | Haci et al. | |
| 2004/0222023 | A1 | 11/2004 | Haci et al. | |
| 2004/0262043 | A1 | 12/2004 | Schuaf | |
| 2008/0197732 | A1* | 8/2008 | Cioceanu | E21B 7/067 310/89 |
| 2011/0061938 | A1 | 3/2011 | Miszewski | |
| 2011/0120775 | A1 | 5/2011 | Krueger et al. | |
| 2013/0051716 | A1* | 2/2013 | Cioceanu | E21B 4/003 384/456 |

* cited by examiner

DOWN HOLE MOTOR APPARATUS AND METHOD

BACKGROUND OF THE INVENTION

This invention relates to down hole motors. More specifically, but without limitation, the invention relates to down hole motors used in drilling deviated and horizontal wellbores.

Down hole drilling motors are widely used in the oil and gas industry. Drilling motors can be employed to achieve high penetration rates, drill hard rock formations, and allow circulation of the borehole. Ultimately, drilling motors have increased drilling efficiency in the drilling of directional holes.

Several drilling motors are used in the industry. For instance, one common type of motor is known as the positive displacement motor (hereinafter "PDM"). The PDM may be referred to as a mud motor. The PDM is energized by translation of high pressure and high volume drilling fluid, air or gas through its various sections. As well understood by those of ordinary skill in the art, drilling motors have three basic components, namely the power section, the bent section, and the bearing section.

In today's industry, there are two primary modes of drilling: the rotary mode and the sliding mode. The rotary mode is used to keep the drill bit on a straight path. With the rotary mode, the entire drill string and bottom-hole assembly (where the mud motor is located) is rotated while drilling. The rotation of the drill string serves several important purposes. The rotation keeps the drill bit on a straight trajectory by cancelling out the effect of the bend in the motor. The rotation reduces the frictional forces between the drill string and the bottom hole assembly and the wellbore by converting the static friction factor (that is created in the sliding mode) to a dynamic one and wherein the reduction of the frictional forces allows more of the applied weight to be transferred to the drill bit, which in turn can result in higher rates of penetration (ROP). Also, the rotation of the drill string reduces the severity of the drill string buckling (that is created in the sliding mode). The rotation of the drill string will twist the drill pipe several wraps about its longitudinal axis, resulting in a relaxed stiffer member with an ability to transfer higher loads to the drill bit than a non-rotating drill string. Also, the stiffer string will facilitate the drilling of the long reach horizontal and vertical wells, which would be impossible with a stationary string due to severe buckling issues. Further, rotation of the drill string and the bottom hole assembly (BHA) creates a stirring effect which helps lift drilled cuttings within the well bore into the path of the returning drill fluid to the surface. This creates a cleaner and smoother well bore which translates into a higher ROP and less friction when moving drill pipe or casing in and out of the well bore.

Nevertheless, operators find it necessary to drill in the slide mode. For instance, operators will drill in the slide mode when the drill bit strays from the intended well path. The drill bit deviates from its trajectory for a multitude of reasons such as bit type, formation force characteristics, wellbore inclination, and uni-directional rotation of the bit, to mention a few. Hence, the operator finds it necessary to bring the bit back into the intended path by steering. Generally, when drilling with a mud motor, the operator will steer the bit by going from the rotary mode to the sliding mode. In the sliding mode, the rotation of the drill string is halted, the bend in the BHA is pointed in the desired corrected direction and drilling resumes in order to get the well path back on the intended track. Rotary drilling can resume when desired by the operator.

SUMMARY OF THE INVENTION

A motor apparatus attached to a work string in a well, with the apparatus having a bit for drilling the well is disclosed. The apparatus comprises: a cylindrical power housing having a rotor-stator member for creating a rotational force, with the power section being attached to the work string; an intermediate cylindrical housing attached to the power housing; and a flexible coupling unit partially disposed within the intermediate cylindrical housing. The apparatus further comprises: a bearing section housing having an end attached to the intermediate cylindrical housing, wherein the bearing section housing contains a thrust bearing module and a radial bearing module, and wherein the bearing section housing is partially disposed about a portion of the flexible coupling unit; wherein the bearing section housing has a first cylindrical section that has a first axis that extends to a second cylindrical section that has a second axis, and the first axis is angularly offset from the second axis so that a bend is created in the bearing housing; and, a power mandrel operatively attached to the flexible coupling unit and disposed within the bearing section housing, and wherein the power mandrel is operatively attached to the bit so that the rotational force imparted by the rotor-stator member is transferred to the bit to drill the well. In one embodiment, the bearing section housing includes: a thrust bearing member for absorbing thrust loads; and, a radial bearing member for absorbing radial loads. The flexible coupling unit may include means for transferring a rotational movement of the rotor-stator member through the bend in the bearing section housing to a drive shaft. Additionally, the bearing section housing may be interchangeable with other variable length bearing section housings. The transferring means may include a first knuckle joint connected to a first end of the drive shaft and a second knuckle joint connected to a second end of the drive shaft. The second knuckle joint may be disposed within the bearing section housing and the first knuckle joint may be disposed within the intermediate housing.

In another embodiment, an apparatus for drilling a well with a bit is disclosed. The apparatus includes: a cylindrical power housing attached to a work string, with the power housing having a power housing axis there through, with the power housing having disposed therein a rotor-stator member for creating a rotational force; a cylindrical intermediate housing attached to the power housing, with the intermediate housing having an intermediate housing axis that is aligned with the power housing axis; and a flexible coupling unit partially disposed within the intermediate cylindrical housing. The apparatus also comprises: a bearing housing having a distal end attached to the intermediate cylindrical housing, with the bearing section housing being partially disposed about a portion of the flexible coupling unit, and the bearing section housing having a first cylindrical section that has a first bearing housing axis that extends to a second cylindrical section that has a second bearing housing axis, and wherein the first bearing housing axis is aligned with the intermediate housing axis and the second bearing housing axis is offset from the first bearing housing axis so that a bend is created in the bearing housing; and a power mandrel operatively attached to the flexible coupling unit and disposed within the bearing housing, and wherein the power mandrel is operatively attached to the bit so that the rotational force imparted by the rotor-stator member is transferred to the bit to drill the well. In this embodiment, the unit comprises means for transferring a rotational movement of the rotor-stator member through the bend in the bearing housing to a drive shaft. Also, the bearing housing is interchangeable with other variable length bearing housings so that multiple axis angle offsets may be formed relative to the power housing. In this embodiment, the bearing section housing may include a thrust bearing member for absorbing thrust loads, and a radial bearing member for absorbing radial loads. The transferring means may include a first knuckle joint connected to a first end of the drive shaft and a second knuckle joint connected to a second end of the drive shaft. In one embodiment, the second knuckle joint is disposed within the bearing housing and the first knuckle joint is disposed with the intermediate housing.

In yet another embodiment, an apparatus for drilling a well with a bit is disclosed. The apparatus comprises: a cylindrical power housing attached to the work string, with the power housing having a power housing axis there through, and wherein the power housing has disposed therein a rotor-stator member for creating a rotational force; a cylindrical intermediate housing attached to the power housing, with the intermediate housing having an intermediate housing axis that is aligned with the power housing axis; and a bearing housing having a distal end attached to the intermediate cylindrical housing, with the bearing housing having a first cylindrical section that has a first bearing housing axis that extends to a second cylindrical section that has a second bearing housing axis so that the first bearing housing axis is aligned with the intermediate housing axis and the second bearing housing axis is offset from the first bearing housing axis so that a bend is created in the bearing housing. The apparatus may further include a flexible coupling unit operatively associated with the intermediate housing and the bearing housing, and a power mandrel operatively attached to the flexible coupling unit and disposed within the bearing housing, and wherein the power mandrel is operatively attached to the bit so that a rotational force imparted by the rotor-stator member is transferred to the bit to drill the well. In this embodiment, the flexible coupling unit comprises means for transferring a rotational movement of the rotor-stator member through the bend in the bearing housing to a drive shaft. Also, the flexible coupling may be partially disposed within the intermediate housing and the bearing housing may be partially disposed about a portion of the flexible coupling unit.

In yet another embodiment, an apparatus for drilling a well with a bit is disclosed. The apparatus includes a power housing attached to a work string, with the power housing having a power housing axis there through, and wherein the power housing has disposed therein a rotor-stator member for creating a rotational force, and a bearing housing having a distal end attached to the power housing; wherein the bearing housing has a first cylindrical section that has a first bearing housing axis that extends to a second cylindrical section that has a second bearing housing axis, and wherein the first bearing housing axis is aligned with the power housing axis and the second bearing housing axis is offset from the first bearing housing axis so that a bend is created in the bearing housing. The apparatus also includes a flexible coupling operatively associated with the bearing housing and a power mandrel operatively attached to the flexible coupling and disposed within the bearing housing, and wherein the power mandrel is operatively attached to the bit so that a rotational force imparted by the rotor-stator member is transferred to the bit to drill the well. In one embodiment, the flexible coupling includes means for transferring a rotational movement of the rotor-stator member through the bend in the bearing housing to a drive shaft. Also, the bearing housing may be interchangeable with other variable length bearing housings.

DETAILED DESCRIPTION OF THE PREFERRED EMBODIMENTS

Figure 1:
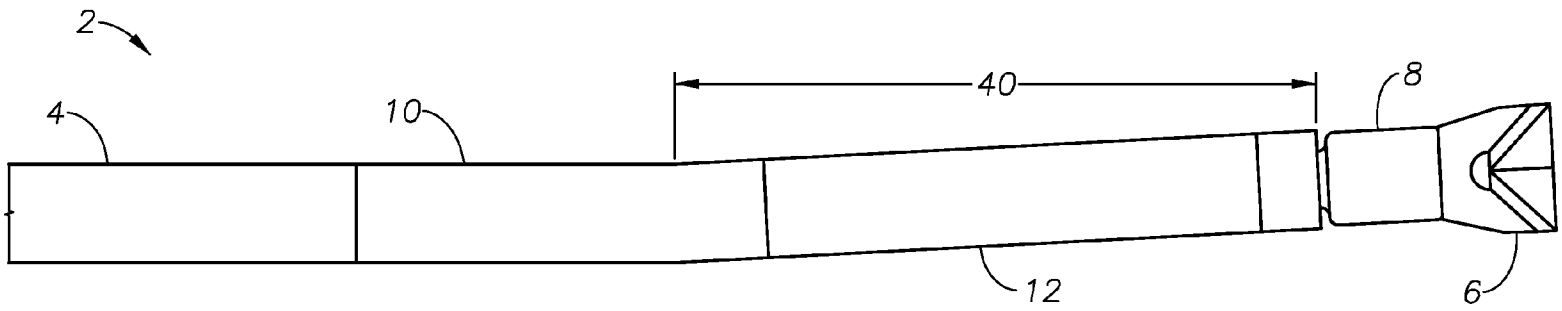
FIG. 1 (Prior Art)
FIG. 1 is a schematic illustration of a first prior art bottom hole apparatus for drilling a well.

Referring now to FIG. 1, a schematic illustration of a first prior art bottom hole apparatus 2 for drilling a well will now be described. The apparatus 2 may be referred to as a down hole mud motor 2, wherein the apparatus 2 is commercially available from National Oilwell Varco Inc. under the name Down Hole Drilling Mud Motor. The power section housing 4 converts hydraulic horsepower of the drilling fluid to mechanical horsepower. More specifically, the power section 4 converts the pumped drilling fluid into a rotational force, as well understood by those of ordinary skill in the art. Ultimately, the rotational force is transferred to the bit 6 at the bit box 8 so that the well may be drilled. The bit 6 may be roller cone bits or fixed cutter bits or other type of boring means to drill wellbores. The power section 4 is operatively connected, such as by thread means to the bent section housing 10, wherein the bent section housing 10 is operatively connected to the bearing section housing 12, such as by thread means. The bent section housing 10 houses the drive shaft, contains the high pressure drilling fluid, air, or gas, and makes the apparatus 2 steerable. The bearing section housing 12 contains the thrust bearings, upper radial bearings and lower radial bearings, as will be further explained later in the disclosure. Also, the bearing section housing 12 directs the drilling fluid, air, or gas to the drill bit 6 for removing cuttings, cooling, and lubricating the drill bit 6, among other things.

Figure 2:
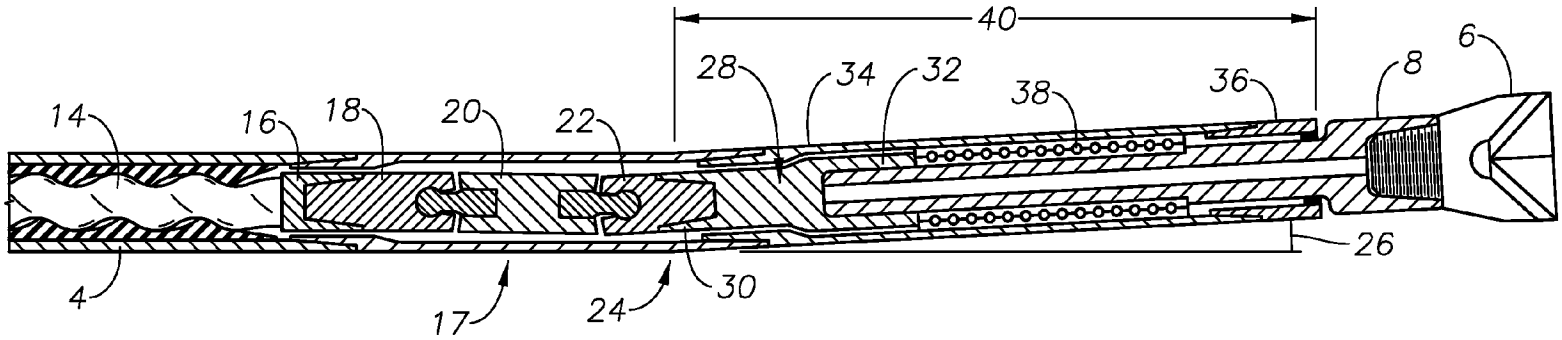
FIG. 2 (Prior Art)
FIG. 2 is a partial cross-sectional view of the first prior art bottom hole apparatus of FIG. 1.

FIG. 2 is a partial cross-sectional view of the first prior art bottom hole apparatus 2 seen in FIG. 1. It should be noted that like numbers appearing in the various figures refer to like components. In the power section housing 4, the rotor-stator member 14 is depicted, wherein the rotor head 16 of the rotor-stator member 14 will be connected to the flexible coupling unit, seen generally at 17. The flexible coupling unit 17 generally comprises the first knuckle joint 18. The knuckle joint 18 will be connected to the driven rod 20 (which may be referred to as the drive shaft 20) which in turn is connected to the second knuckle joint 22. As seen in FIG. 2, the flexible coupling unit 17 is housed within the bent section housing 10. FIG. 2 also depicts the bend, seen generally at 24, wherein the bend angle 26 for the apparatus 2 is generally between zero (0) and three (3) degrees, and in one embodiment is about two (2) degrees. It should be noted that in one embodiment, the transferring means comprises the knuckle joint 18 and knuckle joint 22; however, other means of power transfer are available such as flex shafts, cv joint or any type of drive transmission that converts cylindrical motion from the power section 4 to direct drive to the power mandrel 28.

The second knuckle joint 22 will be attached to a flow diverter 28 (which may be referred to as a power mandrel 28) wherein the flow diverter 28 is housed within the bearing section housing 12. The flow diverter 28 has a first section 30 and a second section 32. As shown in FIG. 2, an upper radial bearing assembly 34 and a lower radial bearing assembly 36 are provided along with the thrust bearing assembly 38. The radial bearings absorb radial loads and the thrust bearings absorb thrust loads. FIGS. 1 and 2 generally depict a prior art embodiment with a standard bend length 40 wherein there is ample space to accommodate an adequate amount of thrust bearings 38, upper radial bearings 34 and lower radial bearings 36.

Figure 3:
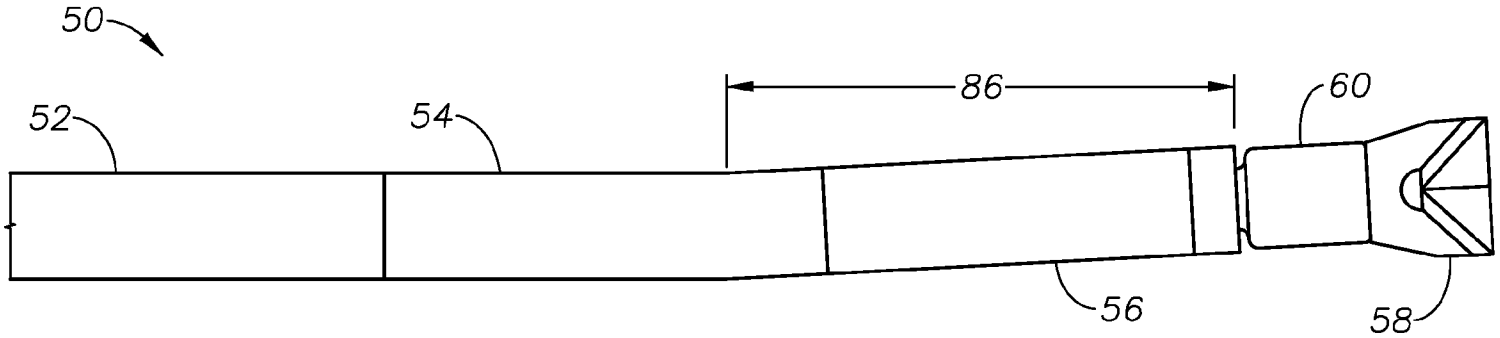
FIG. 3 (Prior Art)
FIG. 3 is a schematic illustration of a second prior art bottom hole apparatus for drilling a well.
Figure 4:
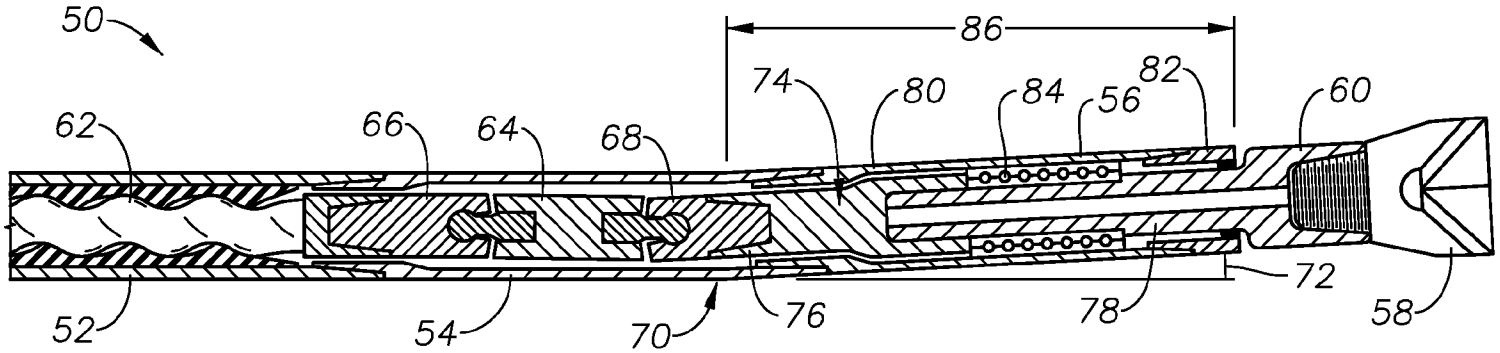
FIG. 4 (Prior Art)
FIG. 4 is a partial cross-sectional view of the second prior art bottom hole apparatus of FIG. 3.

Referring now to FIG. 3, a schematic illustration of a second prior art bottom hole motor apparatus 50 for drilling a well will now be described. The second apparatus 50 includes the power section 52, the bent section 54, and the bearing section 56. Additionally, the bit member 58 is connected to the bit box 60. FIG. 4 is a partial cross-sectional view of the second prior art bottom hole apparatus 50 of FIG. 3. The power section 52 includes the rotor-stator member 62 similar to the rotor-stator member 14 previously mentioned. The bent section 54 includes the driven rod 64, with the driven rod 64 being connected at one end to the knuckle joint 66 and at the other end to knuckle joint 68.

FIG. 4 depicts the bent portion 70 of the bent section 54. The angle 72 formed by the bent section 54 relative to the bearing section 56 is about two (2) degrees. Within the bearing section 56 is the power mandrel, seen generally at 74 (also referred to as the flow diverter) wherein the power mandrel 74 contains first section 76 and a second section 78. The bearing section contains the upper radial bearing assembly 80 and the lower radial bearing assembly 82 as well as the thrust bearings assembly 84. The bend length 86 is denoted in FIG. 4, and wherein the bend length 86 represents the distance from the bend portion 70 to the end of the bit box 60. Hence, the embodiment shown in FIG. 4 represents a short bend length. This short bend length is achieved by removing several rows of thrust bearings and shortening the upper and lower radial bearings. This practice reduces the load capacity of the bearing pack resulting in premature bearing failure due to the high weight on bit (WOB) load and the rotational radial load.

Figure 5:
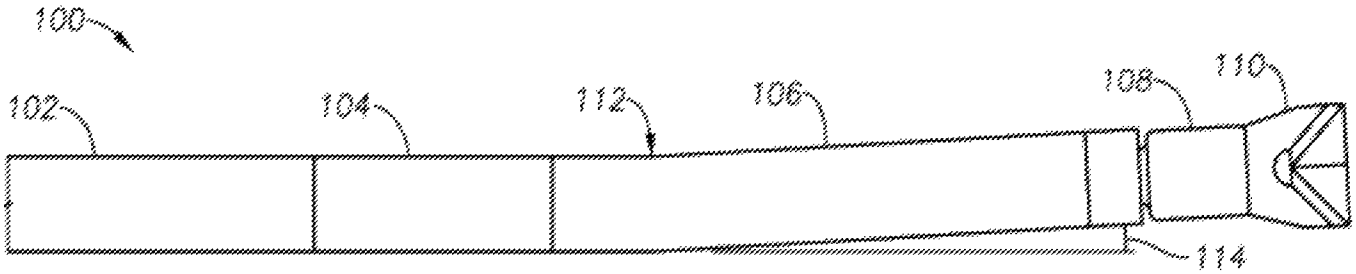
FIG. 5 is a schematic illustration of one embodiment of the presently disclosed bottom hole apparatus for drilling a well.

Referring now to FIG. 5, a schematic illustration of one embodiment of the presently disclosed bottom hole apparatus 100 for drilling a well will now be described. The apparatus 100 includes the cylindrical power section 102 which is connected to the intermediate cylindrical straight or crossover housing 104 which in turn is connected to the bearing section housing 106. A bit box 108 is operatively connected to the bearing section housing, and wherein a bit 110 will be operatively connected to the bit box 108. As seen in FIG. 5, the bend portion 112 is within the bearing section housing 106, and wherein the bend angle 114 is about two (2) degrees. It should be noted that the bend angle may be between slightly above zero (0) degrees to about four (4) degrees, with one embodiment between slightly above zero (0) to about two (2) degrees. The bend angle 114 represents the angular offset at the bend portion 112.

Figure 6:
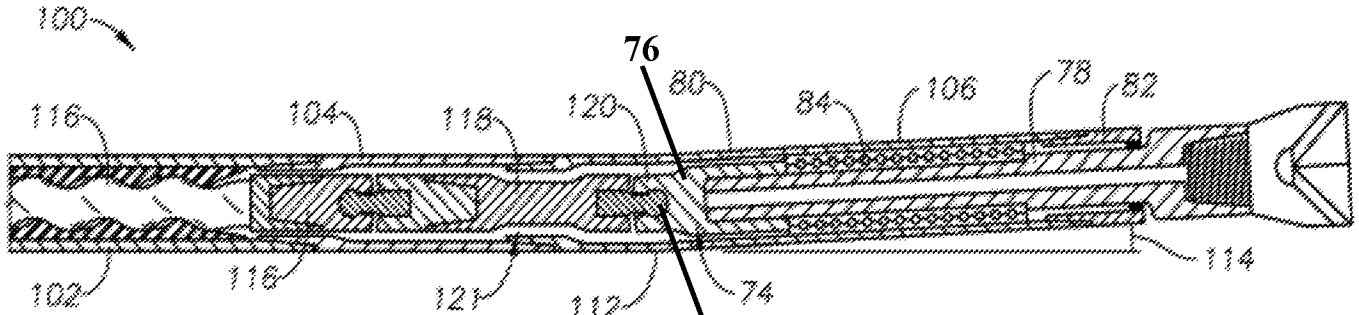
FIG. 6 is a partial cross-sectional view of the bottom hole apparatus embodiment depicted in FIG. 5.

FIG. 6 is a partial cross-sectional view of the bottom hole apparatus 100 depicted in FIG. 5. More specifically, the bottom hole apparatus 100 includes the rotor-stator member 116, wherein the rotor-stator member 116 is concentrically disposed within the power section 102. The rotor-stator member 116 is connected to a first knuckle joint 116, wherein the first knuckle joint 116 is operatively connected to the driven rod 118 which in turn is operatively connected to the second knuckle joint 120. In the embodiment of FIG. 6, the intermediate housing 104 is cylindrical and not bent. A portion of the flexible coupling unit 121 is disposed within the intermediate housing 104, for instance the first knuckle joint 116 and a portion of the drive shaft 118 is disposed within the intermediate housing 104; however, the remaining portion of the drive shaft 118 and the knuckle joint 120 is disposed within the bearing section housing 106. As noted earlier, the bend portion 112 is located on the bearing section housing 106. By having the knuckle joint 120 positioned within the bearing section housing 106, the power mandrel 74 can also be housed totally within the bearing section housing 106. The power mandrel 74 is a straight, cylindrical member as previously described. The power mandrel 74 (also referred to as the flow diverter) can have a first section 76 and a second section 78. As shown, first section 76 of the power mandrel 74 forms part of knuckle joint 120 by way of being directly connected to the knuckle 120*a*, said connection formed within bearing section housing 106. The second section 78 of the power mandrel 74 can be operatively connected with the bit 110.

Figure 7:
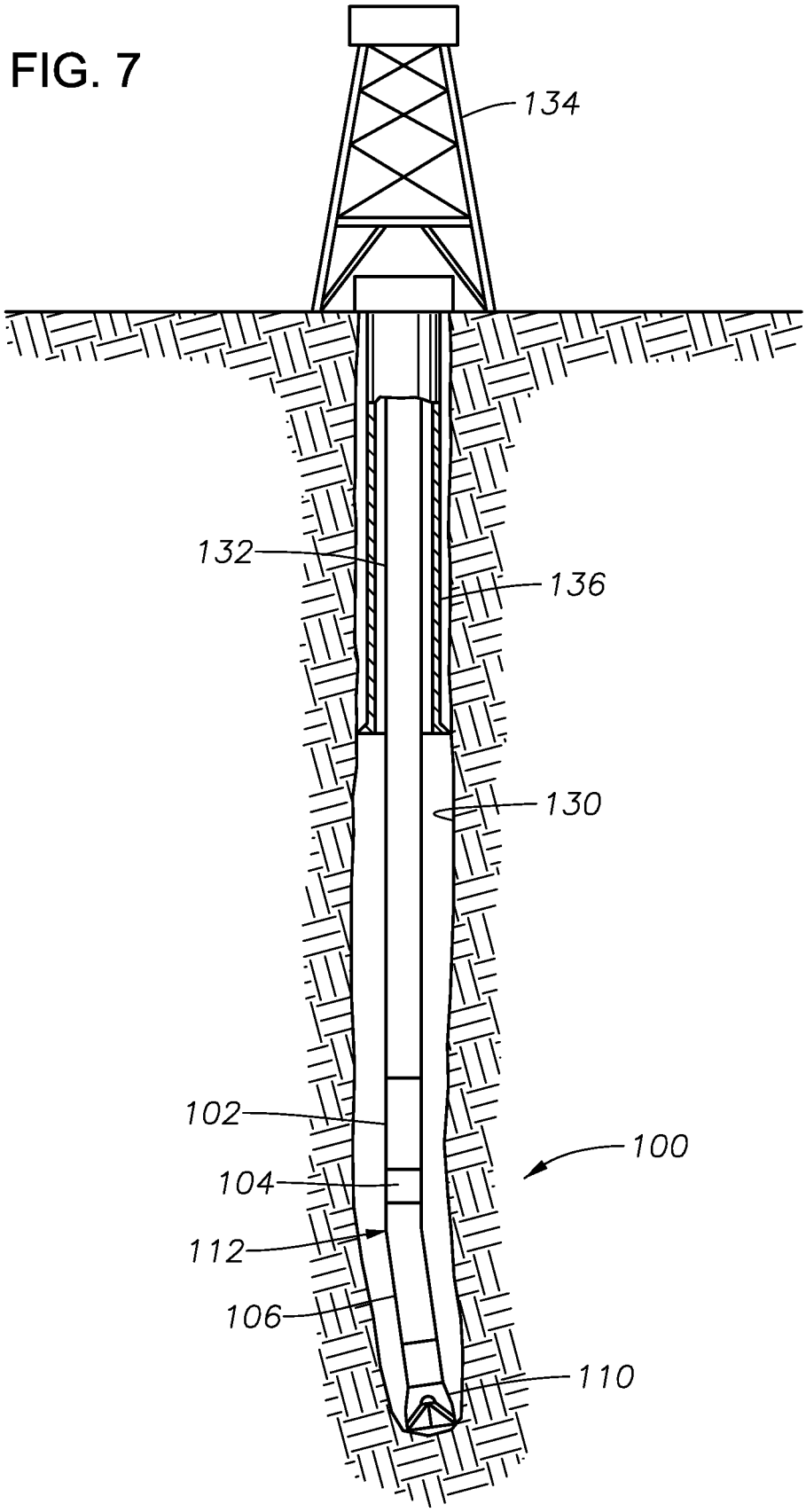
FIG. 7 is a schematic illustration of the apparatus of the present disclosure disposed within a wellbore.

Referring now to FIG. 7, a schematic illustration of one embodiment of the apparatus 100 of the present disclosure disposed within a wellbore 130 will now be described. As seen in FIG. 7, the apparatus 100 is attached to a work string, such as a drill string 132. The drill string 132 extends from a drilling rig 134 which is positioned on the surface. A string of casing 136 extends into the subterranean zones, and wherein the wellbore 130 extends from the casing string 136, with the wellbore 130 being drilled by the bit 110. The apparatus 100 includes the power section 102, the intermediate housing 104 and the bearing section housing 106. The bend portion 112 is also depicted below the intermediate housing 104. In this way, the driller can drill the wellbore 130 in rotary mode. When necessary, the operator can cease the rotary drilling and then commence slide drilling by "pointing" the bit 110 in the correct orientation, and using the mud motor 100, drill the wellbore 130 in a correct, proper inclination. Once the bit path has been reestablished, the operator can commence rotary drilling again.

As per teachings of this disclosure, since the bearing housing 106 is modular and interchangeable, different bearing housing modules may have different lengths thereby providing for multiple axis offsets and positions.

An aspect of one embodiment is that the bent housing and bearing housing have been integrated into a single housing, which in turn allows for a short bend length. The present embodiment shortens the bend length without reducing the bearing capacity or performance. Another aspect of one embodiment is the flexibility of the location of the bend portion which allows for selective bend locations. Since the embodiments disclosed are modular, multiple bend length options are available to the operator.

Another aspect of one embodiment is that the threaded connections of the bearing section are moved away from the bend portion. In one embodiment, by moving the connection away from the bend, the stress level is reduced and/or eliminated which enables the driller to use a more aggressive bend, which results in higher build rate when slide drilling.

Also, by moving the connection away from the bend, it also increases the reliability of the assembly. With the teachings of this disclosure, the bottom hole assemblies containing the aggressive bend angles can still be used in the rotary drilling mode. Also, since the stress level at critical locations (such as the connections) has been reduced and/or eliminated, the life of the bearing housing is prolonged. In one embodiment, the number of connections is reduced by one and/or eliminated between the power section and the bearing section by integrating the bearing housing and the intermediate housing which results in increased reliability and the ruggedness of the assembly. In another embodiment, the intermediate housing 104 could be eliminated all together and the power section could make-up to the bearing housing, which results in a shorter overall length of the motor that still has increased reliability and ruggedness with less connections for potential failures. In addition, by making shorter motors, the MWD and logging tools are closer to the drill bit for receiving data sooner.

Yet another aspect is the ability to drill a short distance in the slide mode then begin rotary drilling as directed by the operator to make a wellbore correction because of the more aggressive bend angles used with this disclosure. Once in the rotary mode, there are less stresses at the top of the bearing section connection because the bend portion is not in the location of the bearing section connection. In one preferred embodiment, the assembly can drill a vertical wellbore, building the curve or deviated section of the wellbore, and continue to drill the horizontal or hold section of the wellbore without pulling out of the wellbore to make an assembly and/or motor configuration change.

Still yet another aspect of one of the embodiments is that the bend in the bearing housing can be anywhere in the bearing section housing below the upper bearing connection. In the prior art, the bend is above the bearing housing or within the upper bearing housing connector.

Although the present invention has been described in considerable detail with reference to certain preferred versions thereof, other versions are possible. Therefore, the spirit and scope of the appended claims should not be limited to the description of the preferred versions or aspects contained herein.

We claim:

1. A motor apparatus attached to a work string in a well, with the apparatus having a bit for drilling the well, the apparatus comprising:

a cylindrical power housing having a rotor-stator member for creating a rotational force, said power housing being attached to the work string;

an intermediate cylindrical housing attached to said power housing;

a flexible coupling unit partially disposed within said intermediate cylindrical housing;

a bearing section housing having an end attached to said intermediate cylindrical housing; wherein said bearing section housing is partially disposed about a portion of said flexible coupling unit; wherein said bearing section housing comprises a bent portion forming a first cylindrical section that has a first axis, and a second cylindrical section that has a second axis, wherein the first cylindrical section and the second cylindrical section join at a point that is axially below a knuckle of said flexible coupling unit within the bearing section housing;

a first section of a power mandrel is operatively and directly attached to the knuckle of said flexible coupling unit, and being disposed within said bearing section housing, wherein a second section of said power mandrel is operatively attached to the bit so that the rotational force imparted by the rotor-stator member is transferred to the bit to drill the well, and further wherein power transfer to the power mandrel occurs within the bearing section housing.

2. The motor apparatus of claim 1 wherein said bearing section housing includes: a thrust bearing member for absorbing thrust loads; and, a radial bearing member for absorbing radial loads.

3. The motor apparatus of claim 2 wherein said flexible coupling unit comprises:

means for transferring a rotational movement of the rotor-stator member through the bend in the bearing section housing to a drive shaft.

4. An apparatus for drilling a well with a bit, the apparatus connected to a work string disposed within the well, the apparatus comprising:

a cylindrical power housing attached to the work string, said power housing having a power housing axis there through, and wherein said power housing has disposed therein a rotor-stator member for creating a rotational force;

a cylindrical intermediate housing attached to said power housing, wherein said intermediate housing has an intermediate housing axis that is aligned with the power housing axis;

a flexible coupling unit partially disposed within said intermediate housing;

a bearing housing attached to said intermediate cylindrical housing; wherein said bearing housing is partially disposed about a portion of said flexible coupling unit; wherein said bearing housing having a first cylindrical section that has a first bearing housing axis that extends to a second cylindrical section that has a second bearing housing axis, and wherein said first bearing housing axis is aligned with the intermediate housing axis and said second bearing housing axis is offset from said first bearing housing axis so that a bend is created in the bearing housing, wherein the bend is axially below a knuckle of said flexible coupling unit within the bearing section housing;

a first section of a power mandrel is operatively and directly attached to the knuckle, and being disposed within said bearing housing, wherein a second section of said power mandrel is operatively attached to the bit so that the rotational force imparted by the rotor-stator member is transferred to the bit to drill the well, and further wherein power transfer to the power mandrel occurs within the bearing housing.

5. The motor apparatus of claim 4 wherein said flexible coupling unit comprises:

means for transferring a rotational movement of the rotor-stator member through said bend in the bearing housing to a drive shaft.

6. The motor apparatus of claim 5 wherein said bearing housing includes: a thrust bearing member for absorbing thrust loads; and, a radial bearing member for absorbing radial loads.

7. The motor apparatus of claim 6 wherein said transferring means includes a first knuckle joint connected to a first end of said drive shaft and a second knuckle joint connected to a second end of said drive shaft.

8. An apparatus for drilling a well with a bit, the apparatus connected to a work string disposed within the well, the apparatus comprising:

a cylindrical power housing attached to the work string, said power housing having a power housing axis there through, and wherein said power housing has disposed therein a rotor-stator member for creating a rotational force;

a cylindrical intermediate housing attached to said power housing, wherein said intermediate housing has an intermediate housing axis that is aligned with the power housing axis;

a bearing housing attached to said intermediate housing; wherein said bearing housing having a first cylindrical section that has a first bearing housing axis that extends to a second cylindrical section that has a second bearing housing axis, wherein said first bearing housing axis is aligned with the intermediate housing axis and said second bearing housing axis is offset from said first bearing housing axis so that a bend is created in the bearing, wherein the first cylindrical section and the second cylindrical section join at a point that is axially below a knuckle of a flexible coupling unit within the bearing section housing, the flexible coupling unit operatively associated with the intermediate housing;

a first section of a power mandrel is operatively and directly attached to the knuckle, and being disposed within said bearing housing, wherein a second section of said power mandrel is operatively attached to the bit so that the rotational force imparted by the rotor-stator member is transferred to the bit to drill the well, and further wherein power transfer to the power mandrel occurs within the bearing housing.

9. The motor apparatus of claim 8 wherein said flexible coupling unit comprises:

means for transferring a rotational movement of the rotor-stator member through the bend in the bearing housing to a drive shaft.

10. The motor apparatus of claim 9 wherein said flexible coupling unit is partially disposed within said intermediate housing and wherein said bearing housing is partially disposed about a portion of said flexible coupling unit.

11. A bottom hole apparatus usable for drilling a well, the bottom hole apparatus comprising:

a power section comprising: a power section housing; and a rotor-stator member for creating a rotational force disposed therein;

an intermediate section comprising: an intermediate section housing connected to the power section housing at a first madeup connection; and a first knuckle joint operatively connected to the rotor-stator member at a first joint end, and operatively connected to a drive shaft at a second joint end; and a bearing section comprising: a bearing section housing connected to the intermediate section housing at a second madeup connection; at least a portion of the drive shaft disposed therein, wherein an end of the drive shaft is operatively connected to a second knuckle joint also disposed therein; and a power mandrel comprising a first section directly connected to a knuckle of the second knuckle joint, and a second section;

wherein the bearing section housing comprises a bend portion formed axially below the second madeup connection, and axially proximate the power mandrel.

* * * * *